US006691717B2

(12) United States Patent
Silva

(10) Patent No.: US 6,691,717 B2
(45) Date of Patent: Feb. 17, 2004

(54) CLIP END HAIR FASTENER

(76) Inventor: David Alan Silva, 2314 Lafayette St., Santa Clara, CA (US) 95050

( * ) Notice: Subject to any disclaimer, the term of this patent is extended or adjusted under 35 U.S.C. 154(b) by 0 days.

(21) Appl. No.: 10/133,066

(22) Filed: Apr. 26, 2002

(65) Prior Publication Data

US 2002/0170569 A1 Nov. 21, 2002

Related U.S. Application Data

(63) Continuation-in-part of application No. 09/860,080, filed on May 16, 2001, now Pat. No. 6,453,911.

(51) Int. Cl.[7] ..... A45D 8/12; A45D 8/20; A41G 5/00

(52) U.S. Cl. ..... 132/275; 132/277; 132/54

(58) Field of Search ..... 132/275, 277, 132/273, 128, 64.1, 53, 54, 55; D28/39, 40, 41; 24/300, 301; 2/323

(56) References Cited

U.S. PATENT DOCUMENTS

| | | | | | |
|---|---|---|---|---|---|
| 4,877,163 | A | * | 10/1989 | Zimmerman | D24/301 |
| 5,037,304 | A | * | 8/1991 | Harper | 2/323 |
| 5,501,239 | A | * | 3/1996 | Walker | 132/275 |
| 5,655,270 | A | * | 8/1997 | Boisvert | 24/301 |
| 5,675,841 | A | * | 10/1997 | Jackson | 2/323 |
| 5,884,371 | A | * | 3/1999 | Huggins | 24/300 |
| 5,899,211 | A | * | 5/1999 | Brown | 132/53 |
| 5,937,867 | A | * | 8/1999 | Williams | 132/53 |
| 6,123,086 | A | * | 9/2000 | Kuglen | 132/275 |
| 6,257,250 | B1 | * | 7/2001 | Sartena | 132/275 |

* cited by examiner

*Primary Examiner*—Todd E. Manahan

(57) ABSTRACT

A clip end hair fastening band for fastening and styling hair comprising an elastic band with claw-toothed clips integrally attached to each end and additional claw clips attached to its underside. The band can be any material including a swatch of hair.

5 Claims, 3 Drawing Sheets

CLIP END HAIR FASTENER

This application is a continuation-in-part and discloses and claims subject matter disclosed in my earlier filed pending application, Ser. No. 09/860,080 filed May 16, 2001 now U.S. Pat. No. 6,453,911.

BACKGROUND OF THE INVENTION

1. Field of the Invention

The present invention relates to a hair fastening band and method, more particularly a band with claw clips integrally attached to each end with a plurality of additional claw clips along the underside of the band.

2. Description of Prior Art

Many people like to secure their hair up and away from their face in various styles. One way to put the hair up is to use a headband or hair band. Traditionally a headband consists of a length of fabric formed into a loop and is placed around the head. A hair band, also traditionally formed into a loop, is secured around a section of hair. Both are effective, however, they both often become loose and less supportive over time.

Another way to secure hair is to use a bungee type fastener with hooks at each end. These are effective for a hairstylist, however, they are difficult to use and extremely difficult to remove for the user.

SUMMARY OF THE PRESENT INVENTION

An object of the present invention is to provide an instrument, which is convenient, practical, and inexpensive for use in hair fastening.

A further object is to provide such an instrument that has hinged and moveable jaws inseparably attached to each end of a band.

A further object is to provide such an instrument that has a plurality of additional claw clips along the underside of the band.

A further object is to provide such an instrument that has a length of hair between each claw clip.

A further object is to provide to provide such an instrument.

A further object is to provide such an instrument where each claw penetrates the hair sections and grasps them tightly.

A further object is to provide such an instrument where the elastic band also grasps the hair.

A further object is to provide such an instrument that can be used unassisted by the individual styling their hair, eliminating the expense of a professional stylist.

A further object is to be able pull up sections of hair and connect them to the band ends.

A further object is to provide an instrument that will quickly hold the user's hair up in a multitude of neatly secured styles.

A further object is to provide a hair fastening band that doesn't become loose on the user's head.

A further object is to provide a hair fastening band that can be used as a headband.

A further object is to provide a hair fastening band that can be used for securing a ponytail.

According to one aspect of the present invention, there is provided a hair fastening band comprising a band with spring-loaded claw clips integrally attached to each end of the band. Further, there is a plurality of additional clips attached to the underside of the band.

According to the arrangement described above the band is attached to the clips in such a way that the teeth of the hair clips can penetrate the user's hair to grasp it and secure the band to the hair. The clips are the "bull-dog" type, wherein the gripping arms of the clips bend in a direction away from the clips pivot in a concave since. Further, the band could be elastic allowing it to be adjustable to different size heads.

Accordingly a preferred embodiment of the present invention the band is a long length of elastic fabric and the clips are spring loaded. The spring loaded clips have a claw like shape and the band can be glued to the inside of one half of each clip, put through an opening of each clip top intermediate the spring and the clip handles and knotted, simply tied to each clip, or any other way to secure it will work as long as the band doesn't get in the way of the teeth penetrating the hair.

A further embodiment of the present invention the band of the above described invention is a length of hair.

A further embodiment of the present invention the band of the above described invention is a length of plastic that connects at each end to a clip with a ball-and-socket joint, hinge, or a snap that makes it removably connected.

A further embodiment of the present invention the band is an elongated pin. Instead of having an individual pin for each clip the plurality of clips are all attached by placing the elongated pin through each clip pivot point, replacing their individual pins with the single band. The pin could be an arched or semicircular "U" shape to clip the band along a French Twist edge or around a bun.

Other objects, features and advantages of the present invention will become apparent from the following description of the preferred embodiments given with reference to the accompanying drawings

DETAILED DESCRIPTION OF THE PREFERRED EMBODIMENTS

Figure 1:
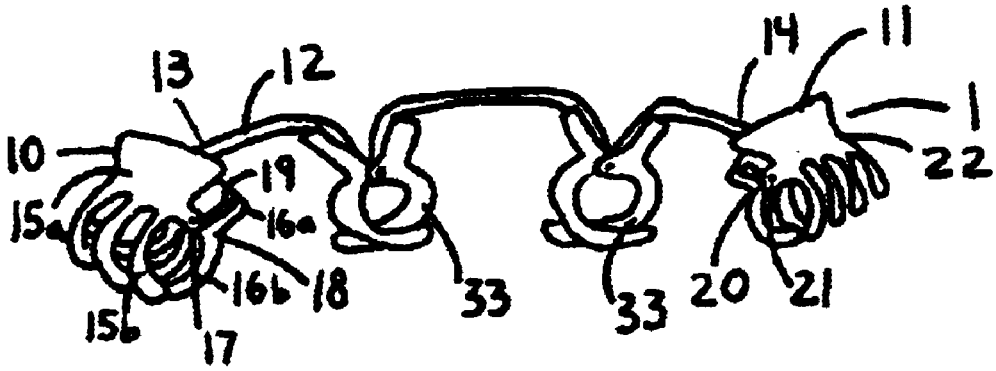
FIG. 1 is a plan view showing a hair band with spring-loaded claw clips attached to each end with a plurality of claw clips attached to the bands underside according to the present invention.

Referring to FIG. 1 of the accompanying drawings. There is illustrated a hair fastening band 1 embodying the present invention. The hair band, generally designated by reference numeral 12, comprises a first clip end 10 and a second clip end 11. The band 12 has additional clips 33 secured along the bottom of the band 12. The resilient band generally designated by reference numeral 12, comprises a first end 13 and a second end 14. In this embodiment the clips 10 and 11 have a first claw and handle portion 15*a* with teeth 15*b* penetrating from claw and handle portion 15*a* and a second claw and handle portion 16*a* with teeth 16*b* penetrating from claw and handle portion 16*a*. Each portion 15*a* and 16*a* has a pair of lugs 17 and 18. The lugs 17 and 18 are aligned with a spring 19 intermediate them and a pin 20 is placed through holes 21 and 22 of lugs 17 and 18. Wherein the first claw and handle portion 15*a* is secured to the second claw and handle portion 16*a*. The band ends 13 and 14 are integrally attached to clips 10 and 11 and the plurality of additional clips 33 are attached along the bottom of the band 12. The clip portions 10, 11, and 33 are made of plastic and the band 12 is made of some type of resilient fabric such as elastic.

Figure 2:
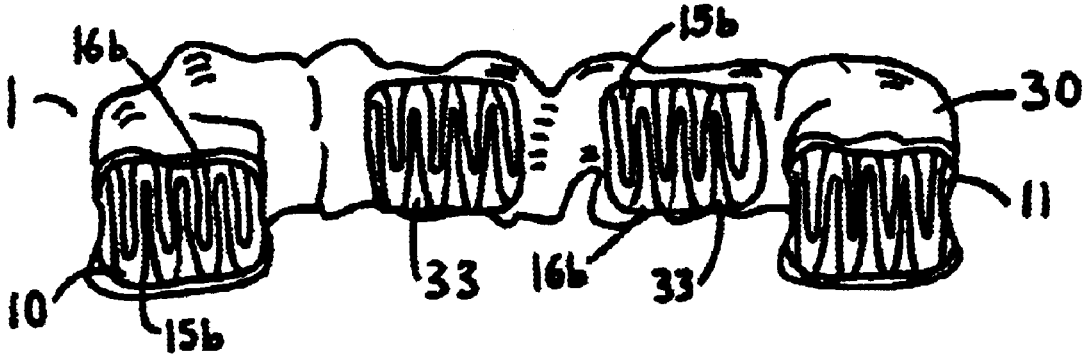
FIG. 2 is a plan view showing the hair band of FIG. 1 covered with fabric.

FIG. 2 shows a fabric covering 30 covering band 12 and clips 10, 11 and 33 leaving an opening for teeth 15*b* and 16*b*.

Figure 3:
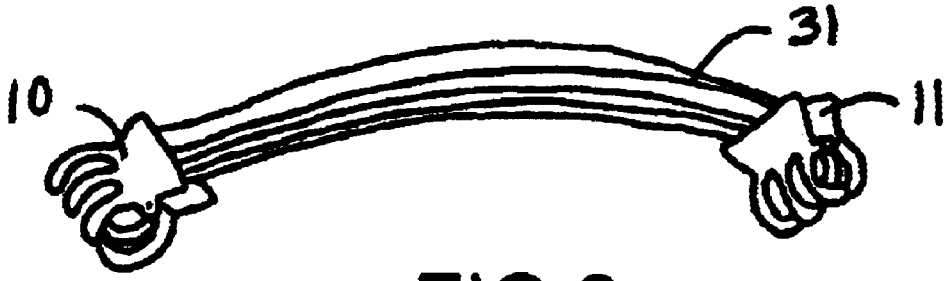
FIG. 3 is a plan view of another embodiment of the current invention.

FIG. 3 the band is a length of hair 31 attached to each clip 10 and 11.

Figure 4:
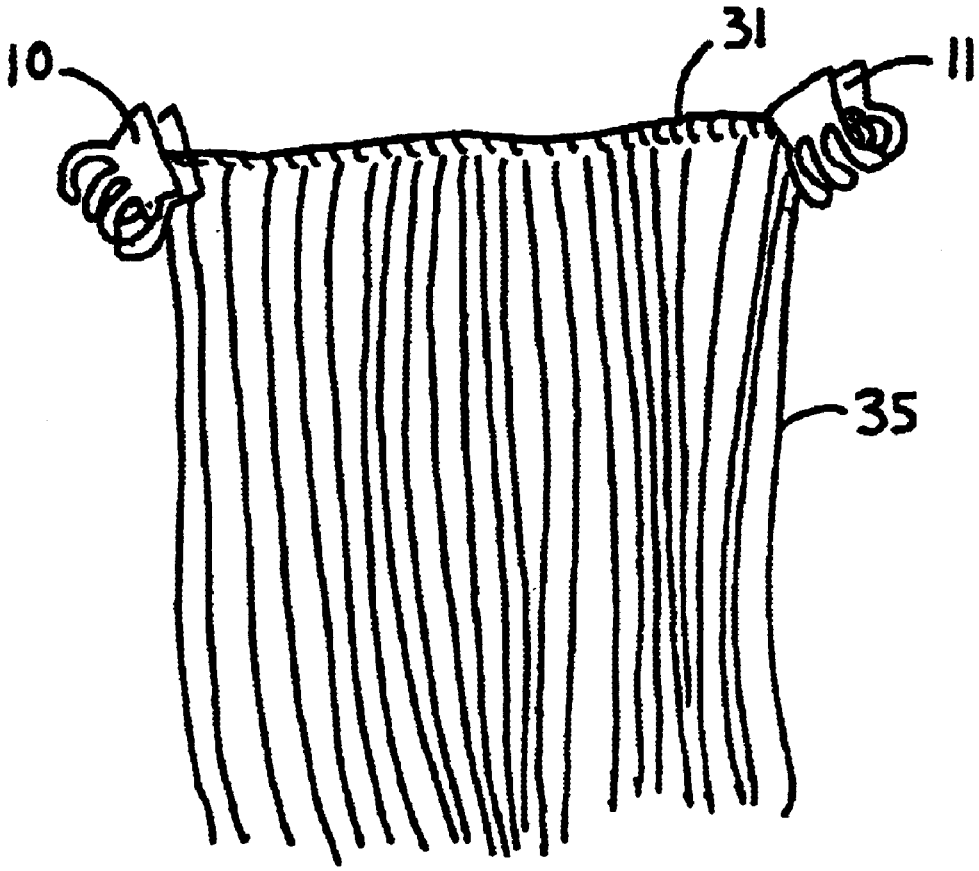
FIG. 4 is a plan view of another embodiment of the current invention.

FIG. 4 shows another embodiment of the length of hair 31 with long hair 35.

Figure 5:
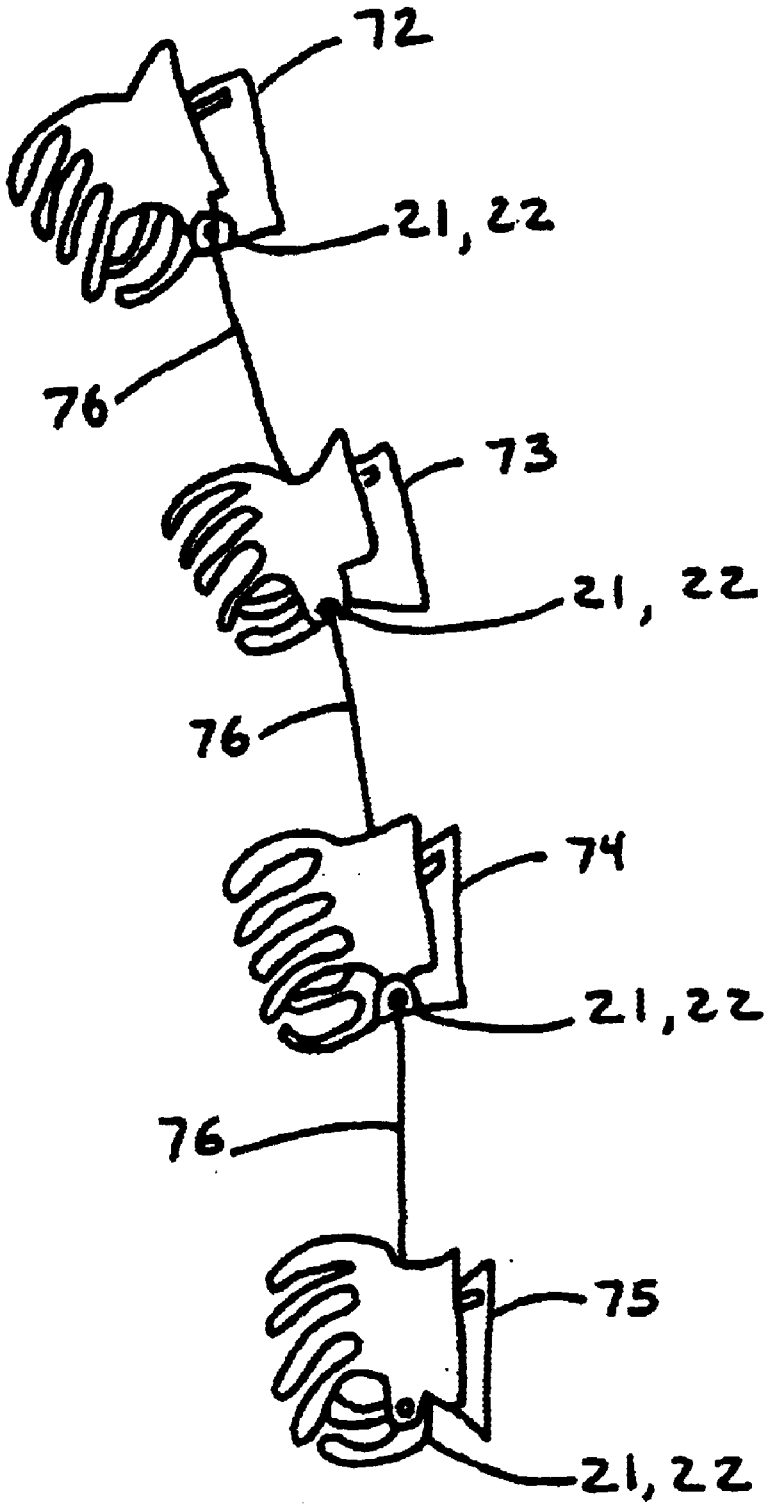
FIG. 5 is a plan view of another embodiment of the current invention.

FIG. 5 shows the clips 72, 73, 74, and 75 with an elongated pin 76 through each clips hole 21 and 22.

The present invention being thus described, it is obvious that the same embodiment and uses may be varied in many ways. For instance, the clip portions can be of different shapes, sizes or configurations as long as they have teeth that fasten to the hair by penetrating the section in a grasping motion, the jaws have a mutual pivotal connection, and the clips have a way to open and close the jaws. The band portion can be of different shapes, sizes, or materials and the hair swatch could have additional clips along it. The clips don't have to be secured directly at the band ends, they could be close to the ends. Any way to style the hair with the present embodiment applies. Further, any way to attach the band ends to the clips will work. Such variations are not to be regarded as a departure from the spirit and scope of the invention, and all such variations as would be obvious to those skilled in the art are intended to be included within the scope of the following claims,

What is claimed is:

1. A method of securing and styling hair comprising: selecting a hair fastening band comprising:

a band with a first and a second spring loaded clip integrally attached to each end of said band and spring loaded clips attached to the underside of said band;

clamping said first clip to a section of hair; pulling the band portion that is between said first and said second clip over, under, or around a section of hair; clamping said second clip to a section of hair; and, continuing in the same manner until all said clips are secured to a section of hair.

2. A hair fastening band for use in styling hair of a human being comprising in combination:

an elongated band; a hair clip integrally attached to each end of said band; and, a plurality of hair clips integrally attached to said bands underside; each of said clips comprising a pair of jaws having a mutual pivotal connection, each of said jaws having an edge portion spaced from said pivotal connection, said edge portion being formed with mutually engaging gripping teeth; said edge portion and said gripping teeth being bent in a concave sense in a direction away from said pivotal connection; said clips further comprise spring means which urges said edge portions of said jaws together and said gripping means into mutual engagement;

said clips further comprising a pair of ears disposed on the side of said spring means remote from said jaws.

3. The hair fastening band of claim 2 further including an additional layer of fabric is attached by attaching means to cover said band and to partially cover said clips;

wherein an opening is left around said teeth allowing said teeth to penetrate said hair sections while the rest of the band and clips remain hidden within said fabric.

4. A hair fastener for use in styling hair of a human being comprising in combination:

an elongated pin; a hair clip integrally attached to each end of said pin; and, a plurality of hair clips integrally attached along said pin; each of said clips comprising a pair of jaws having a mutual pivotal connection with said elongated pin there-through, each of said jaws having an edge portion spaced from said pivotal connection, said edge portion being formed with mutually engaging gripping teeth; said edge portion and said gripping teeth being bent in a concave sense since in a direction away from said pivotal connection;

said clips further comprise spring means which urges said edge portions of said jaws together and said gripping means into mutual engagement; said clips further comprising a pair of ears disposed on the side of said spring means remote from said jaws claw.

5. The hair fastener of claim 4 wherein said elongated pin is curved.

* * * * *